US008371385B2

(12) United States Patent
Lewis

(10) Patent No.: US 8,371,385 B2
(45) Date of Patent: Feb. 12, 2013

(54) CHRISTMAS TREE AND WELLHEAD DESIGN

(75) Inventor: Caspar G. Lewis, Angus (GB)

(73) Assignee: Vetco Gray Inc., Houston, TX (US)

( * ) Notice: Subject to any disclaimer, the term of this patent is extended or adjusted under 35 U.S.C. 154(b) by 676 days.

(21) Appl. No.: 12/472,960

(22) Filed: May 27, 2009

(65) Prior Publication Data

US 2009/0294131 A1 Dec. 3, 2009

Related U.S. Application Data

(60) Provisional application No. 61/056,639, filed on May 28, 2008.

(51) Int. Cl.
*E21B 33/035* (2006.01)
*E21B 34/04* (2006.01)

(52) U.S. Cl. ..... 166/368; 166/341; 166/350

(58) Field of Classification Search ..... 166/368, 166/341, 350, 351, 75.11, 75.13
See application file for complete search history.

(56) References Cited

U.S. PATENT DOCUMENTS

| | | | | |
|---|---|---|---|---|
| 6,062,314 | A | 5/2000 | Nobileau | |
| 6,076,605 | A | 6/2000 | Lilley et al. | |
| 6,460,621 | B2 | 10/2002 | Fenton et al. | |
| 6,968,902 | B2 | 11/2005 | Fenton et al. | |
| 2003/0089501 | A1 * | 5/2003 | Hartmann | 166/348 |
| 2007/0023189 | A1 | 2/2007 | Kahn et al. | |

FOREIGN PATENT DOCUMENTS

| | | | |
|---|---|---|---|
| GB | 2166775 | A * | 5/1986 |
| GB | 2377954 | B | 2/2005 |
| GB | 2421969 | B | 8/2006 |
| GB | 2437286 | A | 10/2007 |

OTHER PUBLICATIONS

Search Report, Application No. GB0909108.3, dated Sep. 22, 2009.

* cited by examiner

*Primary Examiner* — Thomas Beach
*Assistant Examiner* — James Sayre
(74) *Attorney, Agent, or Firm* — Bracewell & Giuliani LLP

(57) ABSTRACT

The device described herein combines a subsea wellhead and a tree mandrel into a single piece. The wellhead includes a tree valve block having an upper and lower section. The lower valve block section is integral with the wellhead and includes access between the production line and the tubing annulus to the main bore of the wellhead.

16 Claims, 1 Drawing Sheet

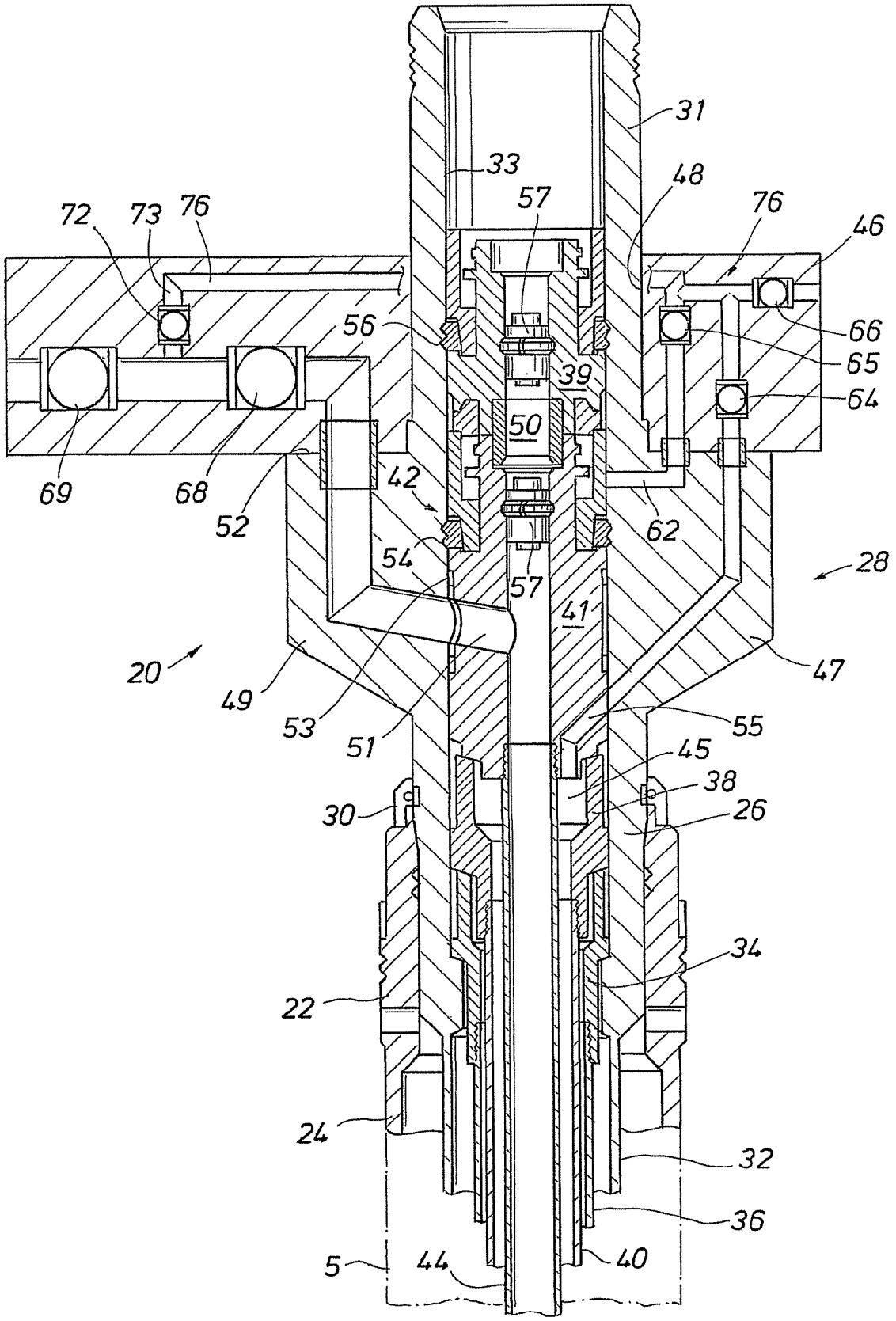
31
33
48
57
76
72
73
76
46
56
66
65
39
64
50
69
68
42
52
62
54
28
57
41
20
47
49
53
51
55
45
38
30
26
34
22
24
32
36
5
44
40

CHRISTMAS TREE AND WELLHEAD DESIGN

CROSS REFERENCE TO RELATED APPLICATIONS

This application claims priority to and the benefit of co-pending U.S. Provisional Application Ser. No. 61/056,639, filed May 28, 2008, the full disclosure of which is hereby incorporated by reference herein.

FIELD OF THE INVENTION

This invention relates in general to production of oil and gas wells, and in particular to a wellhead housing having a tree block and completion hardware that are independently retrievable.

DESCRIPTION OF RELATED ART

Systems for producing oil and gas from subsea wellbores typically include a subsea wellhead assembly that includes a wellhead housing attached at a wellbore opening, where the wellbore extends through one or more hydrocarbon producing formations. Casing and tubing hangers are landed within the housing for supporting casing and production tubing inserted into the wellbore. The casing lines the wellbore, thereby isolating the wellbore from the surrounding formation. Tubing typically lies concentric within the casing and provides a conduit for producing the hydrocarbons entrained within the formation.

Wellhead assemblies also typically include a production tree connecting to the upper end of the wellhead housing. The production tree controls and distributes the fluids produced from the wellbore. Valve assemblies are typically provided within wellhead production trees for controlling the flow of oil or gas from a wellhead and/or for controlling circulating fluid flow in and out of a wellhead. Gate valves and other sliding stem-type valves have a valve member or disc and operate by selectively moving the stem to insert/remove the valve member into/from the flow of fluid to stop/allow the flow when desired.

SUMMARY OF INVENTION

Disclosed herein is a subsea wellhead having a wellhead housing, a tree block with a lower portion that extends into the wellhead housing, the tree block having a mandrel with a cylindrical exterior and an upward facing support surface extending radially outward from a lower end of the mandrel. The wellhead includes a main bore formed axially through the tree block and a tubing hanger for supporting a string of production tubing landed in the main bore. A tubing hanger production passage with a laterally extending tubing hanger production port is included in the tubing hanger. Also included is a tree block production passage within the tree block having a lower inlet that registers with the tubing hanger production port and an upper end that opens at the upward facing support surface and a valve block having a central opening that slides over the mandrel and a bottom that lands on the support surface. The valve block includes a valve block production passage that has an inlet on the bottom of the valve block and which sealingly registers with the upper end of the tree block production passage. At least one valve can be included mounted to the valve block for opening and closing the valve block production passage.

Also disclosed is a wellhead assembly for use subsea, the assembly includes a wellhead housing circumscribing a wellbore opening, a tree block with, a body, a main bore formed through the body and aligned with the wellbore, an annular high pressure housing portion projecting downward from the body and coaxially inserted within the wellhead housing, an annular mandrel with a cylindrical exterior projecting upward from the body and circumscribing the main bore axis, and a landing surface on the body upper end at the base of the mandrel in a plane disposed substantially perpendicular to the axis. The valve block includes a central opening that receives the mandrel and a bottom that lands on the landing surface, a fluid flow passage is in the body that passes sealingly through the landing surface into the valve block. The wellhead assembly includes at least one valve mounted to the valve block for opening and closing the fluid flow passage.

BRIEF DESCRIPTION OF THE DRAWINGS

FIG. 1 is a schematical partial cross sectional view of an embodiment of a subsea wellhead assembly.

DETAILED DESCRIPTION OF THE INVENTION

More specifically, with reference to FIG. 1, an example of a wellhead assembly 20 is shown in a side cross sectional schematic view. The wellhead assembly 20 includes a low pressure housing 22 with conductor pipe 24 extending downward in an opening of a wellbore 5. A production tree 28 collects on the upper end of low pressure housing 22 and houses a main bore coaxial to the wellbore and passages for production, bypass, and workover. The production tree 28 includes a valve support block 47 shown having a body 49 and a high pressure housing 26 downwardly depending from the body 49 that is coupled by a latch 30 to the low pressure housing 22. An annular tree block mandrel 31 projects upward from the body 49 on a side opposite the high pressure housing 26. Mandrel 31 has a cylindrical exterior. The body 49 upper end defines a landing surface 52 extending radially outward from mandrel 31. Landing surface 52 need not be circular, rather it may comprise a generally rectangular surface. The maximum dimension of landing surface 52 from one side edge to an opposite side edge is greater than a diameter of lower pressure wellhead housing 22 in this embodiment.

Further included with the production tree 28 is a valve block 46, shown set on the landing surface 52 and circumscribing the tree block mandrel 31. Valve block 46 has a central cylindrical opening 48 that slides over mandrel 31. There is no need to seal central opening 48 of valve block 46 to the exterior of mandrel 31. If desired, a clamp mechanism may be employed to latch valve block 46 to tree 28. The valve support block 47, high pressure housing 26, and tree block mandrel 31 can be a single modular unit and can optionally be formed from a single piece of stock material. A main bore 33 in the production tree 28 extends coaxial through the tree block mandrel 31, valve support block 47, and high pressure housing 26.

A string of outer casing 32 is secured to the lower end of high pressure housing 26. An intermediate casing hanger 34 with attached and downwardly extending intermediate casing 36 is coaxially landed in the high pressure housing 26. Above the intermediate casing hanger 34 in the high pressure housing 26 is an inner casing hanger 38 shown supporting a string of inner casing 40 that is deployed within the intermediate casing 36. Production tubing 44 suspended coaxially within the inner casing 40 from a tubing hanger 41 defines a tubing annulus 45 between the tubing 44 and the casing 40. The tubing hanger 41 attaches within the valve support block 47 portion of the main bore 33. An axial bore 50 in the tubing hanger 41 registers with the tubing 44. A lower lock ring system 42 couples the tubing hanger 41 to the valve support block 47 with latches 54 that engage in the main bore 33. An upper lock ring system 43 secures an annular tree cap 39 within the main bore 33 with latches 56 that radially project outward to mate with a profile in the main bore 33. Crown plugs 57 are shown in the tubing hanger 41 and tree cap 39 axial bores to redirect fluid flow through the tubing 44 into the production passage 51.

A production passage 51 projects from the axial production bore 50 radially outward through the tubing hanger 41 and into the tree block 28. The passage 51 is shown bored at an angle upward within the tree block 28, with a portion parallel to the main bore 33. Gallery seals 53 seal between main bore 33 and tubing hanger 41 above and below the junction of the portion of production passage 51 in tubing hanger 41 and the portion in tree block 28. The portion of production passage 51 in tree block 28 extends up to landing surface 52. The upper portion of passage 51 extends into the valve block 46 where it changes direction, coursing outward through the valve block 46 periphery. Valves 68, 69 in the production passage 51 regulate flow through the passage 51. A cross-over line 73 within the valve block 46 initiates from the production passage 51 between the valves 68, 69 and connects to a manifold passage 76. A valve 72 in the cross-over line 73 regulates communication between the production passage 51 and manifold passage 76. The manifold passage 76 can be wholly or partially disposed within the valve block 46 or wholly outside of the valve block 46. While shown as a single piece, the valve block 46 can be two separate pieces. In one example, one section can be the valve block 46 portion having the production passage 51 and another section the valve block 46 portion having the passages 62, 55.

A tubing annulus passage 55 in the production tree 28 is shown entering the tubing hanger 41 bottom from the tubing annulus 45, angling upward into and through the valve support block 47. Tubing annulus passage 55 extends through the upper end 52 of valve support block 47 into valve block 46, and terminating at a manifold passage 76 in the valve block 46. Fluid communication between the tubing annulus 45 and manifold passage 76 can be regulated by a valve 64 disposed in a portion of the annulus passage 55 in the valve block 46. The tubing hanger 41 can be oriented to register respective portions of the production passage 51 and tubing annulus passage 55 in the tubing hanger 41 and valve support block 47. Optionally, a gallery annulus (not shown) maybe included in either the tubing hanger 41 or valve support block 47 so that orientation would be unnecessary.

A workover passage 62 juts radially outward from the main bore 33 through the valve support block 47 and passes upward into the valve block 46 where it connects to the manifold passage 76. Flow between the workover passage 62 and the manifold passage 76 is controlled by the valve 65 shown in line with the workover passage 62. The manifold passage 76 can be in fluid communication with the production passage 51, bypass passage 55, or workover passage 62 by selective activation of the valves 72, 64, 65. The manifold passage 76 can be in communication with an external line by operation of valve 66. Manifold passage 76 can also communicate production passage 51 with tree bore 33 via workover passage 62. Thus activating one or more of valves 72, 64, 65 in combination with valve 66 can enable a tubing bypass operation, a workover operation, and/or a completion operation. Although shown as planar, the landing surface 52 can optionally be stepped. In an example, the interface between the valve block 46 and support block 47 adjacent passages 51, 62, 64 may be at different heights within the wellhead assembly 20.

One of the advantages of the embodiment of the production tree 28 disclosed herein is that it is not subjected to high bending or end loads and thus can withstand higher bending loads than current designs. At present a wellhead connector locks the tree to the wellhead with a gasket in between to prevent leakage. The connector must withstand applied bending loads from further up the riser string. Pressure within the connector increases the stress of the connector components and limits the bending capacity of the connector. Without a connector between tree and wellhead elements, bending capacity is dependent on wellhead mandrel 31 capacity and not by pressure or the connector design. The valve block 46 and lockdown mechanism (not shown) need only be designed to withstand the pressure end loads from the production and annulus bores, no other load cases are invisaged. This will enable the valve block weight to be optimized significantly and can remove the requirement for a high strength valve block forging. Designs disclosed herein also allow the completion hardware, including tubing hanger 41, to be removed from within the wellhead assembly 20 without removing or otherwise disturbing the production tree 28 or its associated tree blocks 46, 47. Similarly the upper valve block 46 can be removed from the well head assembly 20 without removal of or otherwise disturbing the completion hardware, including tubing hanger 41. An alignment and lockdown mechanism (not shown) retains the valve block 46 on the wellhead assembly 28.

While drilling the well, after lower pressure wellhead housing 22 and conductor pipe 24 are installed, the operator drills to a depth for receiving outer casing 32. The operator lowers tree 28 and outer casing 32 into low pressure housing 22 and cements outer casing 32. A wear bushing (not shown) will be located within bore 33 to protect the ports of passages 51, 55 and 62 as well as sealing surfaces. Plugs (not shown) will be temporarily installed in the upper ends of passages 51, 55 and 62 at landing surface 52. The operator attaches a drilling riser to mandrel 31, then continues drilling, installing both casing strings 36 and 40.

The operator may complete the well at this time or at a later time using a workover drilling vessel. In one way to complete the well, the operator may remove the wear bushing and the plugs from passages 51, 55 and 62. With the riser detached from mandrel 31, the operator lowers valve block 46 over mandrel 31 and onto valve support block 47. Stabs at the bottom of valve block 46 will seal the upper ends of passages 51, 62 and 55 to mating passages in valve block 46. While a riser is attached to mandrel 31, the operator runs tubing hanger 41 and tubing 44. The operator land and seals tubing hanger 41 in bore 33. The operator may circulate drilling fluid from the cased wellbore by pumping water down the running string, through tubing hanger 41 and out the lower end of tubing 44. With valves 64, 65 open and valves 66, 69 closed, the drilling fluid returns back up the tubing annulus 45, tubing annulus passage 55 and through workover passage 62 into bore 33 above the seals on tubing hanger 41. The returning fluid may flow Up the riser in the annulus surrounding the running string. After perforating, the operator may install a tree cap 54 and a debris cap.

In another method, the operator could install tubing hanger 41 and perforate the well before landing valve block 46. If so, the operator would install a wireline plug within tubing hanger axial passage 50 before removing the riser and landing valve block 46 on support surface 52. Afterward, the operator will remove the wireline plug from tubing hanger 41. The heavier fluid in the wellbore could be circulated out after installing valve block 46 through workover passage 62 in the same manner as described above. Workover operations to kill the well may also be done in the same manner, except a heavier kill fluid would be circulated.

The present system and method described herein, therefore, is well adapted to carry out and attain the ends and advantages mentioned, as well as others inherent therein. While a presently preferred embodiment has been given for purposes of disclosure, numerous changes exist in the details of procedures for accomplishing the desired results. For example, connection between the passages that extend between the upper and lower valve blocks 46, 47 may be accomplished with seal stabs. These and other similar modifications will readily suggest themselves to those skilled in the art, and are intended to be encompassed within the spirit of the present invention disclosed herein and the scope of the appended claims.

What is claimed is:

1. A subsea wellhead comprising:

a wellhead housing;

a valve support block having a lower portion that extends into the wellhead housing, the valve support block having a mandrel with a cylindrical exterior and an upward facing support surface extending radially outward from a lower end of the mandrel;

a main bore formed axially through the valve support block;

a tubing hanger for supporting a string of production tubing landed in the main bore, the tubing hanger having a tubing hanger production passage with a laterally extending tubing hanger production port;

a valve support block production passage within the valve support block having-a lower inlet that registers with the tubing hanger production port and an upper end that opens at the upward facing support surface;

a valve block having a bottom that lands on the support surface and a central opening that slides over and circumscribes the mandrel when the bottom lands on the support surface;

a valve block production passage within the valve block that has an inlet on the bottom of the valve block and which sealingly registers with the upper end of the valve support block production passage; and at least one valve mounted to the valve block for opening and closing the valve block production passage.

2. The subsea wellhead of claim 1, wherein the valve block central opening and the exterior of mandrel are unsealed to each other.

3. The subsea wellhead of claim 2, wherein the mandrel, valve support block, and support surface are formed from a single block of metal.

4. The subsea wellhead of claim 1, wherein an outer periphery of the support surface extends radially outward past an outer diameter of the wellhead housing.

5. The subsea wellhead of claim 1, wherein the support surface on the valve support block is aligned in a plane substantially perpendicular to the main bore.

6. The subsea wellhead of claim 1, wherein the mandrel from the support surface upward is free of any passages extending through a side wall of the mandrel.

7. The subsea wellhead of claim 1, further comprising:

a tubing annulus passage extending through the valve support block, having a lower end at the main bore and an upper end at the support surface.

8. The subsea wellhead of claim 1, further comprising:

a tubing annulus passage extending through a portion of the tubing hanger below seals of the tubing hanger to a side of the tubing hanger, and from the side of tubing hanger, sealingly into the valve support block and up to the support surface;

wherein the tubing annulus passage continues from the support surface sealingly into the valve block and to a tubing annulus port within the main bore above the seals of the tubing hanger; and at least one valve mounted to the valve block for opening and closing the tubing annulus passage.

9. The subsea wellhead of claim 1, further comprising:

a tubing annulus passage extending from a lower tubing annulus port in the main bore of the valve support block below seals of the tubing hanger to the support surface, and from the support surface into the valve block and to an upper port within the main bore above the seals of the tubing hanger; and at least one valve mounted to the valve block for opening and closing the tubing annulus passage.

10. A wellhead assembly for use subsea comprising:

a wellhead housing circumscribing a wellbore opening;

a valve support block comprising:

a body;

a main bore formed through the body and aligned with the wellbore;

an annular high pressure housing portion projecting downward from the body and coaxially inserted within the wellhead housing;

an annular mandrel projecting upward from the body and circumscribing an axis of the main bore, the mandrel having a cylindrical exterior; and a landing surface on the body upper end at the base of the mandrel in a plane disposed substantially perpendicular to the axis;

a valve block having a bottom that lands on the landing surface and a central opening that circumscribes the mandrel when the bottom lands on the landing surface;

a fluid flow passage in the body that passes sealingly through the landing surface into the valve block; and at least one valve mounted to the valve block for opening and closing the fluid flow passage.

11. The wellhead assembly of claim 10, further comprising:

a tubing hanger landed in the lower production tree and selectively retrievable through the main bore;

a tubing hanger production passage in the tubing hanger having a laterally extending outlet; and wherein the fluid flow passage comprises a body flow passage that sealingly joins the outlet of the tubing hanger.

12. The wellhead assembly of claim 10, wherein the central opening of the valve block and the mandrel are in non-sealing engagement with each other.

13. The wellhead assembly of claim 10, further comprising a workover passage and an annulus passage formed in the body that extend into the valve block at the landing surface and wherein the fluid flow passage is a production passage so that landing the valve block onto the landing surface seals the passages.

14. The subsea wellhead of claim 10, wherein the landing surface has a maximum dimension from one side to an opposite side that is greater than an outer diameter of the wellhead housing.

15. The subsea wellhead of claim 10, wherein the mandrel from the support surface upward is free of any passages extending through a side wall of the mandrel.

16. A subsea wellhead comprising:

a wellhead housing;

a tree block having a main bore and a lower portion that extends into the wellhead housing, the tree block having a mandrel with a cylindrical exterior and an upward facing landing surface extending radially outward from a lower end of the mandrel and located in a plane perpendicular to an axis of the mandrel;

a tubing hanger for supporting a string of production tubing landed in the main bore, the tubing hanger having a tubing hanger production passage with a laterally extending tubing hanger production port;

a tree block production passage within the tree block having a lower inlet that registers with the tubing hanger production port and an upper end that faces upward at the upward facing support surface;

upper and lower seals between an exterior of the tubing hanger and the main bore above and below tubing hanger production port, the upper seal being below the plane containing the support surface;

a tree block tubing annulus passage having a lower end in the main bore below the lower seal of the tubing hanger and an upper end facing upward at the support surface;

a tree block workover passage having a lower end in the main bore above the upper seal of the tubing hanger and an upper end facing upward at the support surface;

a valve block having a central opening that slides over the mandrel and a bottom that lands on the support surface;

a valve block production passage within the valve block that has an inlet on the bottom of the valve block and which sealingly registers with the upper end of the tree block production passage;

a valve block tubing annulus passage having a lower end that sealingly registers with the upper end of the tree block tubing annulus passage;

a valve block workover passage having a lower end that sealing registers with the upper end of the workover passage; and wherein the valve block tubing annulus passage and the valve block workover passage having a junction with each other in the valve block.

* * * * *